US006199785B1

(12) United States Patent
Paugh

(10) Patent No.: US 6,199,785 B1
(45) Date of Patent: Mar. 13, 2001

(54) RATCHET MECHANISM FOR A REEL

(76) Inventor: Edward C. Paugh, 1460 S. Balboa Ave., Ontario, CA (US) 91762

( * ) Notice: Subject to any disclaimer, the term of this patent is extended or adjusted under 35 U.S.C. 154(b) by 0 days.

(21) Appl. No.: 09/407,143

(22) Filed: Sep. 28, 1999

(51) Int. Cl.[7] ..... B65H 75/30
(52) U.S. Cl. ..... 242/385.4; 242/378.1
(58) Field of Search ..... 242/385, 385.2, 242/385.3, 385.4, 396, 396.1, 396.2, 396.5, 396.6, 396.8, 376, 378.1

(56) References Cited

U.S. PATENT DOCUMENTS

| | | | |
|---|---|---|---|
| 171,825 | | 1/1876 | Lawton . |
| 306,576 | | 10/1884 | Brown . |
| 352,502 | | 11/1886 | Young . |
| 557,832 | | 4/1896 | Knight . |
| 887,689 | | 5/1908 | Olop . |
| 1,831,666 | | 11/1931 | Jacobia . |
| 3,233,591 | * | 2/1966 | Rogers et al. . |
| 4,114,736 | | 9/1978 | Scherenberg . |
| 4,543,806 | * | 10/1985 | Papandrea et al. . |
| 4,773,623 | * | 9/1988 | Nabinger . |
| 4,901,938 | | 2/1990 | Cantley et al. . |
| 4,907,348 | * | 3/1990 | Hubbard, Jr. . |
| 5,400,521 | * | 3/1995 | Waldherr . |
| 5,509,616 | | 4/1996 | Millen, Jr. et al. . |
| 5,762,281 | | 6/1998 | Foley . |

* cited by examiner

*Primary Examiner*—Donald P. Walsh
*Assistant Examiner*—William A. Rivera
(74) *Attorney, Agent, or Firm*—Pretty & Schroeder, P.C.

(57) ABSTRACT

A ratchet mechanism for a retractor includes a flat spring (72), securely disposed between an interior surface of the sidewall (30) and an outside diameter surface (64) of a cylindrical spool (60). The flat spring has a detent (92) integrally formed thereon. The detent slidably engages notches (68) formed on the outside diameter surface to permit rotation in one direction but not the other. The ratchet mechanism further includes a thumb slide (74) that engages the flat spring and releases the detent from the notches to allow the spool to rotate under the force of the torsional spring (62).

7 Claims, 4 Drawing Sheets

RATCHET MECHANISM FOR A REEL

CROSS-REFERENCES TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates generally to the field of winding devices, and more particularly, to a ratchet mechanism for a retractor. Although the present invention is subject to a wide range of applications, it is especially suited for use as a small-card retraction device, and will be particularly described in that connection.

2. Description of the Related Art

A ratchet mechanism for a retractor prevents the retractor from retracting a cord into the housing of the retractor. Typically, ratchet mechanisms consist of a pawl which has a spring or gravity return and in the case of a mechanics rachet wrench the pawl can be "one direction" locking through a lever so that force can be applied in either a clockwise (CW) or counterclockwise (CCW) direction. Other similar devices, for example, spring-driven clock escapements, are intended to arrest a toothed gear from continuous movement to incremental rotation. All subject similar devices use a pawl which is fixed in the mechanism by a pivot pin. The pawl can be influenced in one direction by a spring or the force of gravity. The pawl is rendered inactive, or caused to be reversible, by a lever actuator.

In one example of a conventional retractor, U.S. Pat. No. 4,901,938 discloses an electrical cord retractor. A spiral spring biases a spool in the CW direction. A detent formed of a strip of springy metal is fixed at one of its ends to the inner surface of a base by a pin. Intermediate its ends, the detent presents a bulge adapted to engage indentations in a toothed wheel. When the bulge engages in one of the indentations, the detent prevents rotation of the spool under the influence of the spring.

An elongated actuator has one end located adjacent to the bulge and the other end extends through a hole in the base and carries a pushbutton. When the pushbutton is depressed, an end of the actuator pushes the bulge out of engagement with the indentations, thereby releasing the latching function of detent and wheel so as to free the spool for rotation by the spring. When the pushbutton is released, the resilience of the detent returns the actuator to its initial position and permits the bulge to engage one of the indentation to relatch the spool.

Although suitable for some applications, this retractor, however, does not allow the cord to be freely pulled out the ratchet wheel without actuating the lever and is an elaborate design requiring many parts that increases the cost of the retractor.

In another example of a conventional retractor, U.S. Pat. No. 5,509,616 discloses a retractable chalk line device. In particular, it discloses a thumb slide assembly for controlling the spool. The thumb slide assembly includes a thumb grip slidably mounted on a casing. A pair of opposed tabs project from the thumb grip and straddle the spool and engage associated teeth which are located on the opposing faces of the spool. When the grip is in a neutral position, the opposed tabs are disengaged from the spool teeth, allowing dispensing or retraction of the string. When the thumb grip is in a locked position, the opposed tabs are engaged with the spool teeth to restrict movement of the string.

Although suitable for some applications, this retractor, however, has the tabs in direct engagement with the teeth, which required the thumb assembly and teeth to be reinforced to handle the excessive wear and tear. Further, this retractor does not allow the cord to be freely pulled out without actuating the thumb assembly once it is in the locked position.

All of the above described devices require a number of expensive components, operate both above and to the side of the rotating member, take up an inordinate amount of space, and are typically reinforced to transmit torque from one rotating member to another.

A need therefore exists for a ratchet mechanism for a reel that provides the advantages of allowing the string to be freely pulled out the ratchet wheel without actuating the lever, simplifying the actuator design, and reducing the cost of the ratchet mechanism.

BRIEF SUMMARY OF THE INVENTION

The present invention, which tends to address this need, resides in an improved ratchet mechanism for a retractor. The ratchet mechanism described herein provides advantages over known ratchet mechanisms in that it allows the string to be freely pulled out and latched without actuating the lever, simplifies the actuator design, and reduces the cost of the ratchet mechanism. Further, the ratchet mechanism does not disturb the face of the reel, which leaves it available for decoration.

According to the present invention, a spring driven spool is prevented from rotation by a detent integrally formed on a flat spring disposed between a sidewall of the reel and the outside diameter surface of the spool. The detent engages a notch formed in the outside diameter surface when the notch rotates to the position of the detent, thus preventing the spool to rotate in a winding direction. The detent automatically disengages from the notch as the spool rotates in an unwinding direction. A thumb slide is mounted in the sidewall and engages the flat spring. The thumb slide acts on the flat spring to disengage the detent from the notch, thus allowing the spring-driven spool to rewind.

In accordance with one aspect of the present invention, the notch is right-triangle shaped and the the detent is isosceles-triangle shaped.

Other features and advantages of the present invention will be set forth in part in the description which follows and accompanying drawings, wherein the preferred embodiments of the present invention are described and shown, and in part become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

DESCRIPTION OF THE PREFERRED EMBODIMENTS

Figure 1:
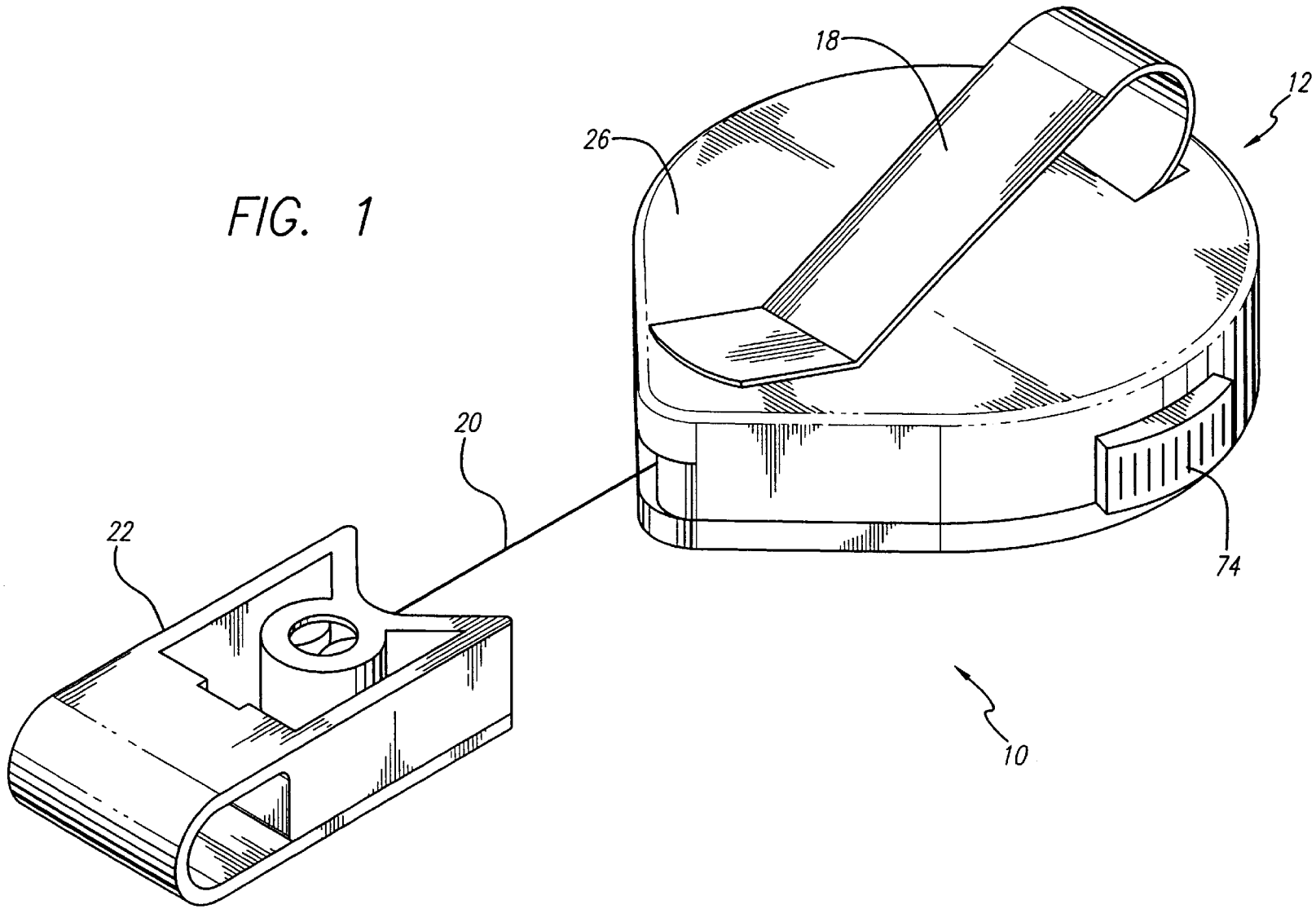
FIG. 1 is a perspective view of the back of a retractor configured according to the present invention.
Figure 2:
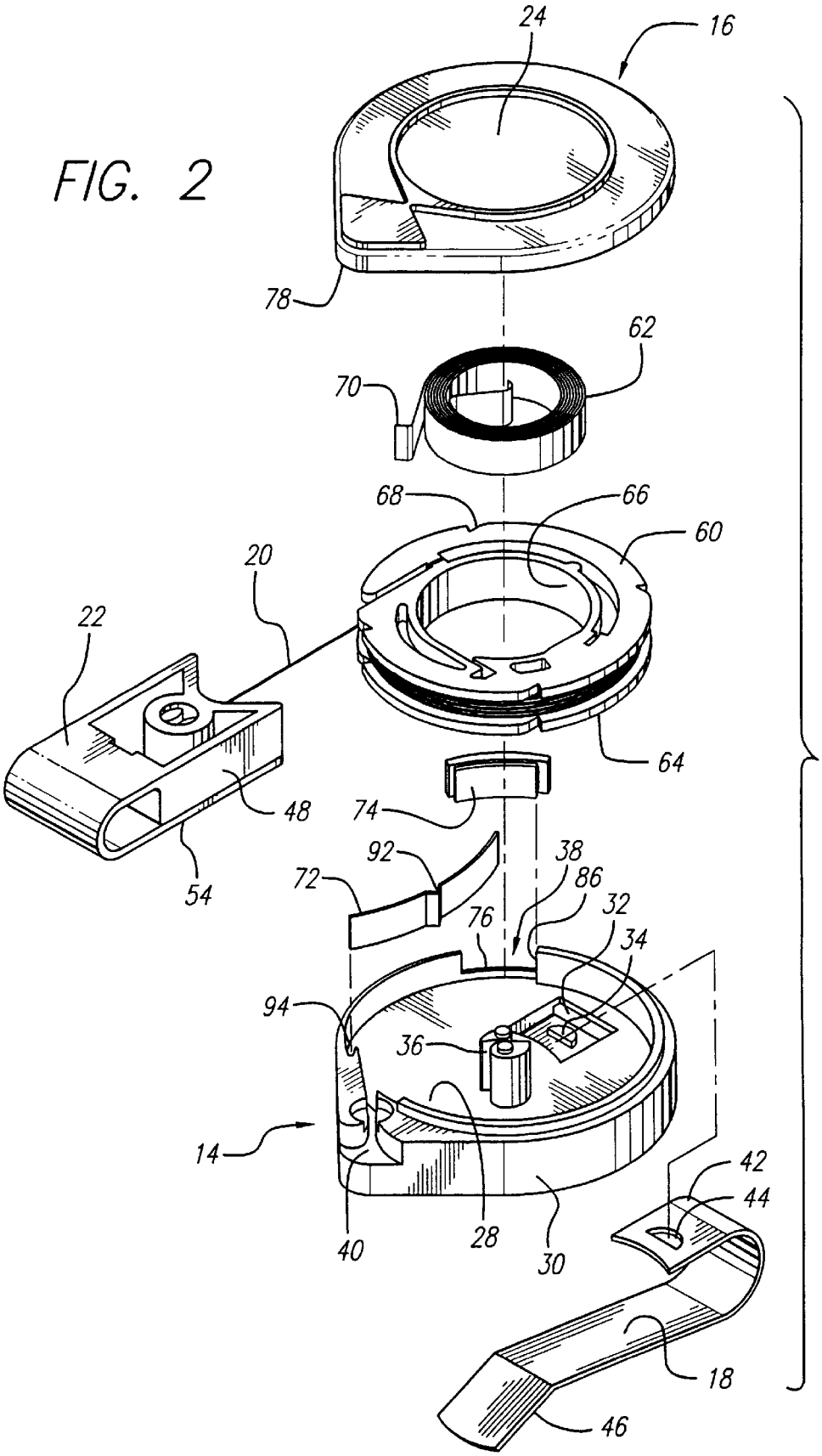
FIG. 2 is an exploded perspective view of the front of the retractor shown in FIG. 1.

As shown in the exemplary drawings, the present invention is embodied in a retractor 10 comprising a casing 12 having a back casing 14 and a front casing 16, a pocket clip 18, a winding mechanism, a cord 20, and a card clip 22.

The back casing 14 and a front casing 16 house the internal mechanism of the retractor 10. They can be ultrasonically welded together. The front casing and back casing each have an exterior surface 24, 26 and an interior surface 28 defining a hollow interior area of the casing 12. In this illustrated embodiment, the casing is substantially cylindrical shaped, the front exterior surface is substantially flat, and the back exterior surface is substantially flat. One of ordinary skill in the art will recognize that the casing can be made of rigid plastic using injection molding techniques.

The exterior surface 24 of the front casing 16 can be used to for decoration. For example, a label having company's name or logo thereon can be stuck to the exterior surface. This is an advantageous feature because the retractor 10 can be given away as a promotional item. As will described below, a ratchet mechanism is arranged advantageously so as not to obstruct the exterior surface of the front casing.

The back casing 14 also includes a sidewall 30 extending from the back exterior surface 26 and abutting the front casing 16. The back casing also has a slot 32 formed therethrough. The interior surface 28 of the back casing has a key post 34 and split post 36 extending therefrom. The sidewall also has a slot 38 and channel 40 formed therethrough. In this illustrated embodiment, the sidewall is substantially circular except where the channel is formed.

The pocket clip 18 is used to clip the retractor 10 to clothing of a person. The pocket clip is S-shaped and is affixed to the back casing 14. A first end 42 of the pocket clip is inserted into the slot 32 of the back casing 14 and a key opening formed in the first end of the pocket clip engagingly mates with the key post 34 of the back casing. In this position, a second end 46 of the pocket clip abuts the exterior surface 26 of the back casing. To fix the pocket clip to the person, the clothing is inserted between the second end and the exterior surface. In the illustrated embodiment, the pocket clip is made of metal, and the configuration of the pocket clip keeps it under tension to secure the pocket clip to the back casing.

The cord 20 couples the card clip 22 the winding mechanism. The cord has a first end and a second end. The first end is affixed to the winding mechanism, and the second end of the cord exits the channel 40 and is affixed to the card clip.

Figure 3:
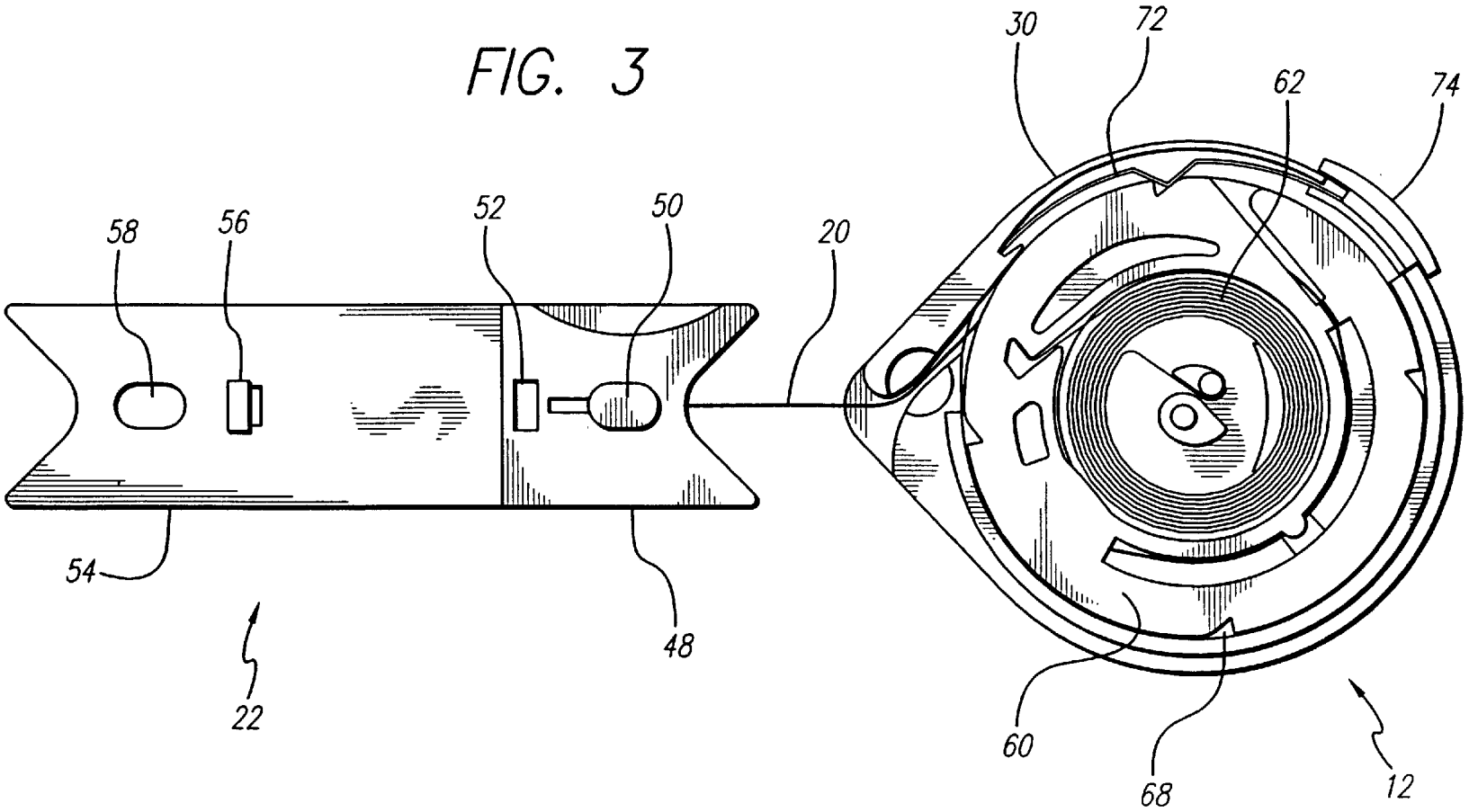
FIG. 3 is a front view of the assembled retractor shown in FIG. 1 having the front casing removed therefrom and the card clip unfolded.

The card clip 22 affixes the small card to the cord 20. The small card can be, for example, a security card or casino card. As best shown in FIG. 3, the card clip is U-shaped having a first end 48 with a first post 50 protruding therefrom and a slot 52 formed therethrough, and a second end 54 having a second post 56 protruding therefrom and a hole 58 formed therethrough. To affix the small card, the second end is inserted through an elongated slot formed in the small card and the second end is folded over upon the first end. First post and second post are configured to engagingly mate with the hole and slot, respectively, to secure the first end and second end together.

The winding mechanism winds and unwinds the cord 20. The winding mechanism is disposed within the interior area of the casing and includes a cylindrical spool 60 and a torsional spring 62.

The cylindrical spool 60 is rotatable with respect to the housing and carries the wound cord 20. The spool has an outside diameter surface 64 upon which the cord is wound and an inside diameter surface 66 defining an annular opening in the cylindrical spool. The first end of the cord is affixed to the cylindrical spool. Further, the outside diameter surface has at least one notch 68 formed on the cylindrical spool. In the illustrated embodiment, four equally spaced notches are shown.

The torsional spring 62 biases the cylindrical spool 60 in a CW direction, in the illustrated embodiment, providing the force to rotate the spool to wind the cord 20. The torsional spring is substantially disposed within the annular opening of the cylindrical spool. A first end 70 of the torsional spring is affixed to the cylindrical spool and a second end of the torsional spring is stationarily affixed to the split post 36. In this configuration, the torsional spring biases the spool against one side of the sidewall 30. The torsional spring is wound with sufficient force to retract the cord until the card clip 22 abuts the sidewall. The cord is unwound by gripping the card clip and pulling on it to overcome the winding force supplied by the torsional spring.

In this illustrated embodiment, which is configured according to the present invention, the retractor 10 further includes a ratchet mechanism. The ratchet mechanism includes a flat spring 72 and a thumb slide 74.

The thumb slide 74 acts as a lever to release the flat spring 72. The thumb slide is slidably mounted in the slot 38 of the sidewall 30 and is held in the slot between the bottom edge 76 of the slot and a ridge 78 formed on the perimeter of the interior surface of the front casing 16. The bottom edge and ridge fit into a top channel 80 and a bottom channel formed in the thumb slide. The thumb slide includes a first end 82 adapted as a catch for engaging an end 90 of the flat spring and a second end 84 adapted as a stop for engaging a side edge 86 of the slot 38.

Figure 4:
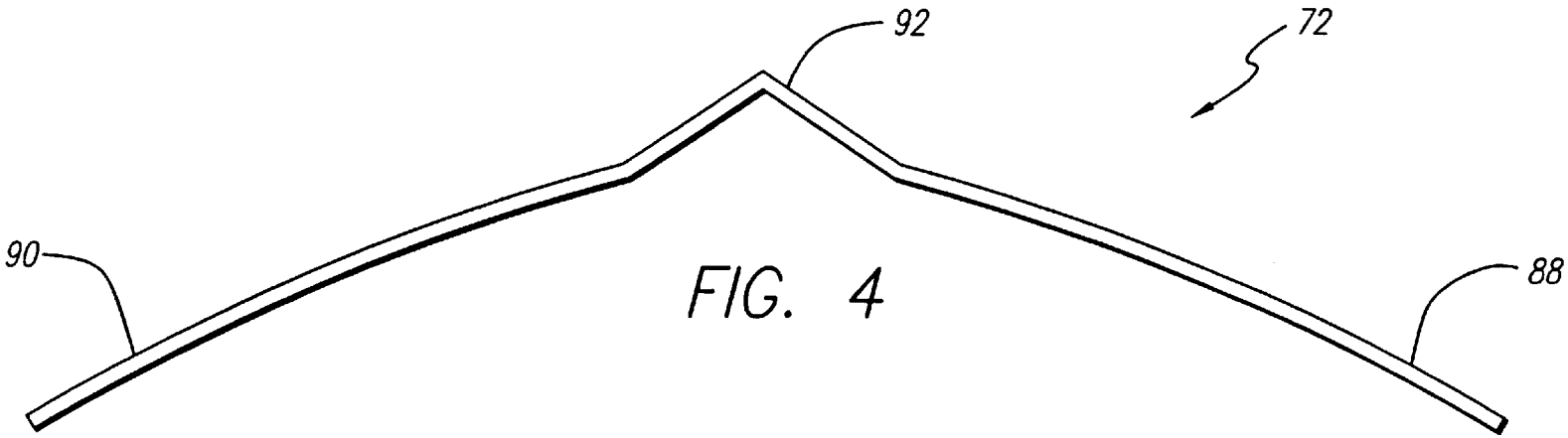
FIG. 4 is a top plan view of a relaxed flat spring shown in FIG. 3.
Figure 5:
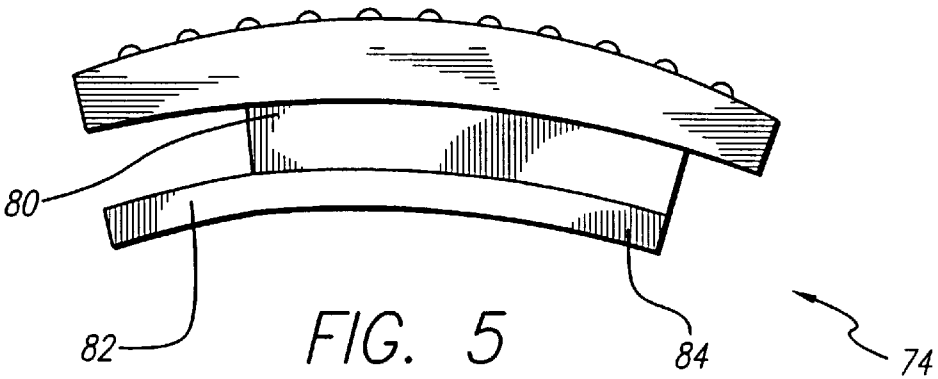
FIG. 5 is a top plan view of a thumb slide shown in FIG. 3.

The flat spring 72 functions as a pawl to prevent clockwise motion of the spool 60 and thus the winding of the cord 20 and retraction of the attached small card. As shown in FIG. 4, which is a top plan view of the relaxed flat spring, the flat spring is slightly bowed and has a first end 88, a second end 90, and a detent 92 formed integrally on the flat spring between the first end and the second end.

As shown in FIG. 3, the flat spring 72 is securely disposed under compression between the outside diameter surface 64 of the cylindrical spool 60 and the interior surface of the sidewall 30 opposite the side of the sidewall that the spool is biased against by the torsional spring 62. The sidewall and the spool are configured such that a channel therebetween can receive the flat spring. The sidewall further has a first catch 94 formed thereon on the interior surface of the sidewall. The first catch is adapted to receive the first end 88 of the flat spring.

In this assembled position, the flat spring 72 forces the detent 92 radially inward. The detent is adapted for engaging a notch 68 when the notch rotates to the position of the detent. In this illustrated embodiment, the detent is isosceles-triangle shaped and the notches are right-triangle shaped. To prevent CW motion, and winding of the cord wider the force of the torsional spring 62, the detent is pushed radially into the notch and the edge of the detent rests against the radially directed edge of the notch.

As the cord 20 is unwound by a person pulling on the card clip 22, the spool 60 rotates and the notch 68 and the detent 92 slidably disengage. The other leg of the detent slides up the sloping edge of the notch and the flat spring 72 is forced towards the sidewall 30. The tip of the detent slides across the outside diameter surface 64 of the spool until the next notch rotates to the position of the detent. If the unwinding tension on the cord is released before the next notch reaches the detent, the spool will rotate clockwise under the force of the torsional spring until the previous notch reaches the detent.

To retract the extended cord 20 and card clip 22, the thumb slide 74 is slid away from the side edge of the slot in a CCW direction. The catch 82 of the thumb slide forces the flat spring 72 towards the sidewall 30, which causes the detent to disengage from the notch 68. The torsional spring 62 then rotates the spool 60 causing the cord to be wound in and the attached small card retracted.

In conclusion, the ratchet mechanism for a retractor described herein provides advantages over known ratchet mechanisms in that it allows the cord to be freely pulled out and latched without actuating the lever, simplifies the actuator design, and reduces the cost of the ratchet mechanism. Further, the ratchet mechanism does not disturb the face of the reel, which leaves it available for decoration. This is primarily accomplished by a flat spring having a detent integrally formed thereon and adapted for engaging the notches on the spool, and a thumb slide that engages the flat spring to disengage the detent from the notch.

Those skilled in the art will recognize that other modifications and variations can be made in the ratchet mechanism for a retractor of the present invention and in construction and operation of this ratchet mechanism without departing from the scope or spirit of this invention.

What is claimed is:

1. A retractor for retracting small cards, the retractor comprising:

a casing including a front casing and a back casing, the front casing and back casing each have an interior surface defining a hollow interior area, the front casing further has an exterior surface, the back casing further has an exterior surface and a sidewall abutting the front casing, the sidewall has a slot and channel formed therethrough and a first catch formed thereon on the interior surface of the sidewall;

a cord having a first end and a second end, the second end of the cord exiting the channel;

a winding mechanism, disposed within the interior area of the housing, for winding the cord, the winding mechanism including, a cylindrical spool, rotatable with respect to the housing, having an outside diameter surface upon which the cord is wound and an inside diameter surface defining an annular opening in the cylindrical spool, the first end of the cord being affixed to the cylindrical spool, the outside diameter surface has at least one notch formed thereon, and a torsional spring substantially disposed within the annular opening, having a first end affixed to the cylindrical spool and a second end stationarily affixed to the housing;

a ratchet mechanism including, a flat spring, securely disposed between the interior surface of the sidewall and the outside diameter surface of the cylindrical spool, having a first end, a second end, and a detent integrally formed thereon between the first end and the second end, the detent adapted for engaging the at least one notch, and wherein the first catch is adapted to receive the first end of the flat spring, and a thumb slide, slidably mounted in the slot, including a first end adapted as a second catch for engaging the second end of the flat spring, and a second end adapted as a stop for engaging an edge of the slot, wherein the detent engages the at least one notch when the at least one notch rotates to the position of the detent and disengages from the at least one notch when the thumb slide is slid away from the edge of the slot.

2. The retractor of claim 1, wherein the at least one notch and the detent are adapted to slidably disengage when a predetermined unwinding tension is applied to the cord.

3. The retractor of claim 2, wherein the detent is isosceles-triangle shaped.

4. The retractor of claim 2, wherein the at least one notch is right-triangle shaped.

5. The retractor of claim 4, wherein the detent is isosceles-triangle shaped.

6. The retractor of claim 1, further comprising a card clip secured to the second end of the cord.

7. The retractor of claim 1, wherein the housing is substantially cylindrical shaped, the exterior front surface is substantially flat, the exterior back surface is substantially flat, and the sidewall is substantially circular.

* * * * *